US009708848B2

(12) United States Patent
Chu

(10) Patent No.: US 9,708,848 B2
(45) Date of Patent: Jul. 18, 2017

(54) MAGNETIC CURTAIN AND SLIDING PANEL FORMED THEREFROM

(71) Applicant: Neo-Kingstone Industrial Co., Ltd., Taipei (TW)

(72) Inventor: Chen-Ho Chu, Taipei (TW)

(73) Assignee: NEO-KINGSTONE INDUSTRIAL CO., LTD., Taipei (TW)

( * ) Notice: Subject to any disclaimer, the term of this patent is extended or adjusted under 35 U.S.C. 154(b) by 0 days.

(21) Appl. No.: 14/990,379

(22) Filed: Jan. 7, 2016

(65) Prior Publication Data

US 2016/0235237 A1 Aug. 18, 2016

(30) Foreign Application Priority Data

Feb. 17, 2015 (TW) ..... 104105586 A

(51) Int. Cl.
*E06B 9/262* (2006.01)

(52) U.S. Cl.
CPC ..... *E06B 9/262* (2013.01); *E06B 2009/2622* (2013.01); *E06B 2009/2625* (2013.01)

(58) Field of Classification Search
CPC ..... E06B 9/262; E06B 2009/2622; E06B 2009/2625
USPC ..... 160/184, 196.1, 197, 348, DIG. 16
See application file for complete search history.

(56) References Cited

U.S. PATENT DOCUMENTS 3,911,991 A * 10/1975 Malferrari ..... A47H 1/04 160/197
4,397,346 A * 8/1983 Chumbley ..... E06B 9/24 160/84.01
4,921,032 A * 5/1990 May ..... E06B 9/262 160/348
5,010,944 A * 4/1991 Bussert ..... A47H 99/00 160/348
5,109,910 A * 5/1992 Tortorella ..... A47H 15/04 160/197
6,832,642 B2 * 12/2004 Titus ..... A47H 13/00 160/330
6,988,526 B2 * 1/2006 Judkins ..... E06B 9/262 160/84.01
7,150,304 B2 * 12/2006 Hsu ..... E06B 9/262 160/348

(Continued)

FOREIGN PATENT DOCUMENTS

AU 2011101135 A4 10/2011
DE 202011004612 U1 6/2011

*Primary Examiner* — David Purol
(74) *Attorney, Agent, or Firm* — Muncy, Geissler, Olds & Lowe, P.C.

(57) ABSTRACT

A magnetic curtain and a sliding panel formed therefrom are revealed. A magnetic curtain includes an upper portion, a lower portion, a plurality of a plurality of middle portions arranged between the upper portion and the lower portion, and a plurality of magnetic parts disposed on an interface between two adjacent portions of the magnetic curtain. While the magnetic curtain is retracted, the two adjacent middle portions are folded in half in turn to form a curved part respectively. The two adjacent curved parts are away from each other so as to prevent protrusion and extension caused by overlapping of the curved parts. Thus the magnetic curtain has more applications and higher use efficiency.

5 Claims, 12 Drawing Sheets

(56) References Cited

U.S. PATENT DOCUMENTS

| | | | | |
|---|---|---|---|---|
| 8,905,114 | B1 * | 12/2014 | Whitaker | E06B 9/262 160/348 |
| 2004/0144505 | A1 * | 7/2004 | Johnson | A47H 13/00 160/348 |
| 2006/0249260 | A1 * | 11/2006 | Nien | A47H 13/00 160/84.03 |
| 2012/0102707 | A1 * | 5/2012 | Chen | E06B 9/262 29/428 |
| 2012/0103539 | A1 * | 5/2012 | Chen | E06B 9/24 160/113 |
| 2012/0234502 | A1 * | 9/2012 | Chen | E06B 9/262 160/84.01 |

* cited by examiner

MAGNETIC CURTAIN AND SLIDING PANEL FORMED THEREFROM

BACKGROUND OF THE INVENTION

The present invention relates to a magnetic curtain and a sliding panel formed therefrom, especially to a magnetic curtain having a plurality of portions and a plurality of magnetic curtain and a sliding panel formed therefrom. The magnetic curtain includes an upper portion, a plurality of middle portions and a lower portion. The length of the respective middle portion is decreased gradually, increased gradually, or decreased and increased alternatively from bottom to top. There is a difference in length, equal or unequal, between the two adjacent middle portions. Thus there is a certain distance between a curved part on a bottom of the later folded middle portion and a curved part formed on a bottom of the first folded middle portion while the magnetic curtain is retracted. Therefore protrusion and extension caused by overlapping of the two adjacent curved parts can be avoided.

The roman shade is a common window shade formed by a suspended fabric disposed with a plurality of horizontal rods arranged at the fabric with the equal interval. While in use, the horizontal rods are driven by a drive member and a blind cord on a lateral side of the shade to retract or extend the fabric. However, the roman shade has shortcomings of complicated drive mechanism, more effort required for pulling the blind cord, a strangulation hazard to children, etc. In order to overcome the above shortcomings, a cordless curtain with functions of retraction and extension similar to the Roman shade is disclosed, as revealed in U.S. Pat. No. 7,150,304, DE 20 2011 004 612U1, AU2011101135A4, etc. In these prior arts, the horizontal rods arranged equidistantly are replaced by a plurality of magnetic components. While in use, the fabric is moved upward and folded in half time after time while the magnetic component at the lowest position is attracted to magnetic component at the upper position to be positioned at the required height (as revealed in U.S. Pat. No. 7,150,304). However, the magnetic components are disposed equidistantly on the fabric, as the rods on the Roman shade. Thus a plurality of doubled-over portions (the equally-folded bottoms) is formed while the fabric is retracted. A curved part of the respective doubled-over portion is at the same height due to equidistantly-arranged magnetic components. Thus the curved parts are overlapped with one another, protruding and extending from the fabric. Therefore the appearance of the retracted curtain/shade is seriously affected. The curtain/shade is used less efficiently and the consumer's intension to purchase the shade/shade is affected negatively.

Moreover, a sliding panel is also a kind of common shade. The sliding panel generally includes a rail, a plurality of carrier tracks disposed under the rail and a plurality of panels connected to and arranged under the carrier track respectively. A connector and a runner such as pulley are set on top of each carrier track. Thus the runner is slid in a channel of the rail by the connector inserted into the rail and the respective carrier track and the corresponding panel are slid horizontally and gradually extended to form a window shade. Or the respective carrier track and the corresponding panel are retracted gradually to be overlapped at one side. Thus the window can be seen through. The panel of the conventional sliding panel is formed by a fabric with the same preset length. Although the fabric can be made from different materials, the respective panel is unable to be moved upward, folded and positioned at the required height.

Within the competitive market, a various kinds of innovative shades/curtains are available one after the other. Unfortunately, the options of sliding panel are limited by a lack of innovative ideas. The conventional sliding panel can be extended gradually or retracted gradually in the horizontal direction to be overlapped at one side. The respective panel of the sliding panel is unable to be retracted and positioned at the required height, or extended vertically.

Thus there is room for improvement and a need to provide a magnetic curtain that overcomes shortcomings of the shades/curtains having structure similar to roman shades yet without curtain cords such as U.S. Pat. No. 7,150,304, DE 20 2011 004 612U1, AU2011101135A4, etc. The magnetic curtain is further applied to a new sliding panel that is able to be retracted and positioned at the required height. At the same time, other problems derived from applications of the sliding panel can be solved by technical features of the magnetic curtain. The sliding panel is used more efficiently.

SUMMARY OF THE INVENTION

Therefore it is a primary object of the present invention to provide a magnetic curtain that overcomes shortcomings of conventional magnetic curtain such as protrusion and extension caused by overlapping of curved parts and improves the use efficiency of the magnetic curtain.

It is another object of the present invention to provide a magnetic curtain and a sliding panel formed therefrom having a wider application range and higher use efficiency.

In order to achieve the above objects, a magnetic curtain of the present invention includes an upper portion, a lower portion, a plurality of a plurality of middle portions arranged between the upper portion and the lower portion, and a plurality of magnetic parts disposed on an interface between two adjacent portions of the magnetic curtain. The length of the respective middle portion is decreased gradually, increased gradually, or increased and decreased alternatively. Thus there is a difference in length, equal or unequal, between the two adjacent middle portions. While the magnetic curtain is retracted, one of the middle portions is folded in half and the magnetic part at the lowest position is attracted to the second lowest magnetic part. When the two adjacent middle portions are folded in half in turn, the lower middle portion is firstly folded to form a first folded middle portion and the upper middle portion is then folded to form a later folded middle portion located at the rear side of the above first folded middle portion. There is a certain distance between a curved part formed on a bottom of the first folded middle portion and a curved part formed on a bottom of the later folded middle portion. The protrusion and extension caused by overlapping of the two adjacent curved parts can be avoided.

A sliding panel formed from a plurality of magnetic curtains of the present invention is provided. The respective magnetic part on the two adjacent magnetic curtains is not at the same height. There is a height difference between the magnetic parts on one of the magnetic curtains and the magnetic parts on the adjacent magnetic curtain. Thus the magnetic parts on the two adjacent magnetic curtains will not be attracted to each other while the respective magnetic curtain is slid horizontally under a rail set to be extended gradually or retracted gradually.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Please refer to the following embodiments and the figures to learn the structure and technical features of the present invention. Each component is not drawn to scale.

Figure 1:
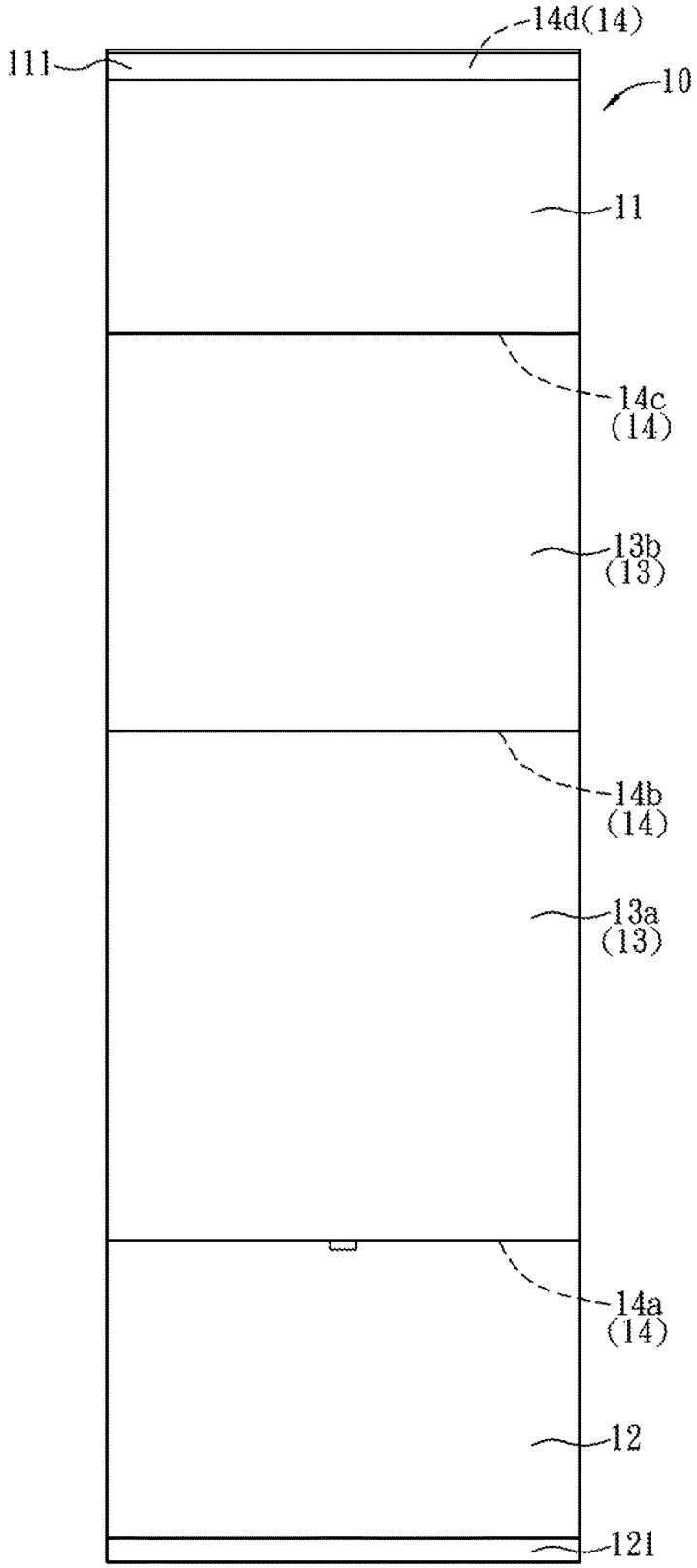
FIG. 1 is a front view of an embodiment having two middle portions with decreased length from bottom to top of a magnetic curtain according to the present invention.

Refer to FIG. 1, a magnetic curtain 10 of the present invention includes an upper portion 11, a lower portion 12, a plurality of middle portions 13 (13*a*, 13*b*) arranged between the upper portion 11 and the lower portion 12, and a plurality of magnetic parts 14 (14*a*, 14*b*, 14*c*). A top end 111 of the upper portion 11 can be fixed on a window (not shown in figure) by other components. Thus the magnetic curtain 10 is used as a shade between an indoor space A and an outdoor space B, as shown in FIG. 1. A bottom end 121 of the lower portion 12 can be used in combination with other components such as load to keep the magnetic curtain 10 straight and look beautiful.

Figure 7:
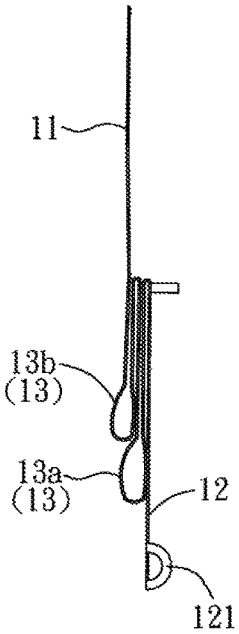
FIG. 7 is a side view of the embodiment in FIG. 1 being moved forward and folded in half the second time according to the present invention.
Figure 9:
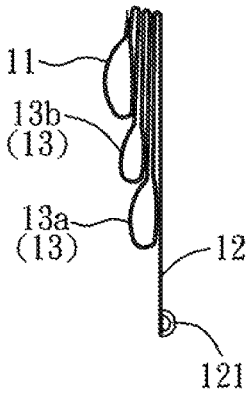
FIG. 9 is a side view of the embodiment in FIG. 1 being moved forward and folded in half the third time according to the present invention.

The present invention features on that the number of the middle portions 13 is not limited and is set according to the length of the magnetic curtain 10. The length of respective middle portion 13 is increased gradually, decreased gradually, or increased and decreased alternatively from bottom to top. Thus there is a length difference, equal or unequal, between the two adjacent middle portions 13. Thereby the magnetic part 14 at the lowest position is gradually moved upward to be attracted to the second lowest magnetic part 14 and one of the middle portions 13 therebetween is folded in half. When the two adjacent middle portions 13 are folded in half in turn, the lower middle portion 13 is folded in half first to form a first folded middle portion 13 while the upper middle portion 13 is folded in half later to form a later folded middle portion 13 that is located at a rear side of the first folded middle portion 13 mentioned above while the magnetic curtain 10 being folded upward. Moreover, there is a certain distance between a curved part on a bottom of the later folded middle portion 13 and a curved part on a bottom of the first folded middle portion 13. That means the two curved parts are not in parallel or at the same height. Thus protrusion and extension caused by overlapping of the two adjacent curved parts can be avoided, as shown in FIG. 7 and FIG. 9.

Refer to FIG. 1, in this embodiment, the middle portions 13 include a lower middle portion 13*a* and an upper middle portion 13*b*. The length of the respective middle portion 13 is decreased gradually from bottom to top. There is a length difference between the two middle portions 13*a*, 13*b* and the length of the lower middle portion 13*a* is larger than the length of the upper middle portion 13*b*. The length difference is ranged from 8 cm to 14 cm, but not limited to this range.

Figure 2:
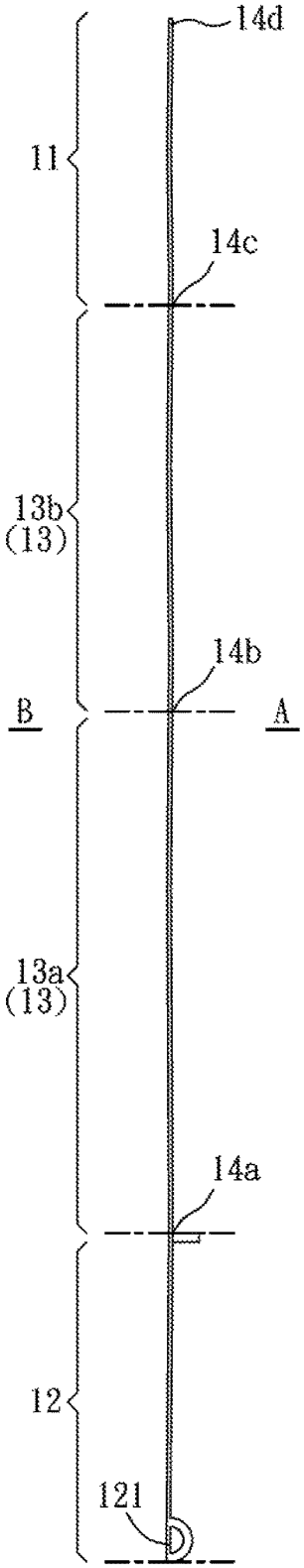
FIG. 2 is a side view of an embodiment having two middle portions with the decreased length from bottom to top according to the present invention.
Figure 3:
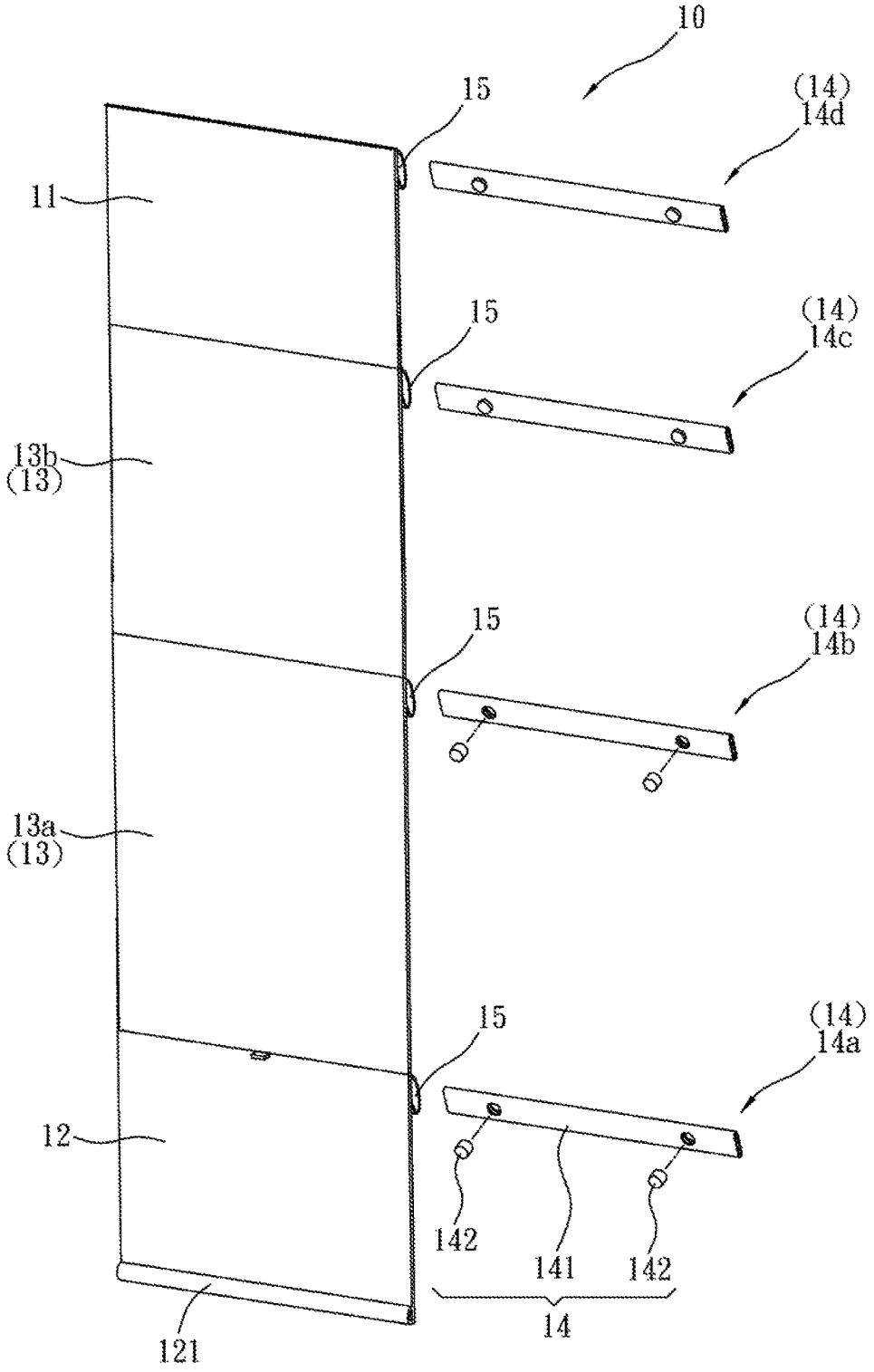
FIG. 3 is an explosive view of the embodiment in FIG. 1 according to the present invention.
Figure 8:
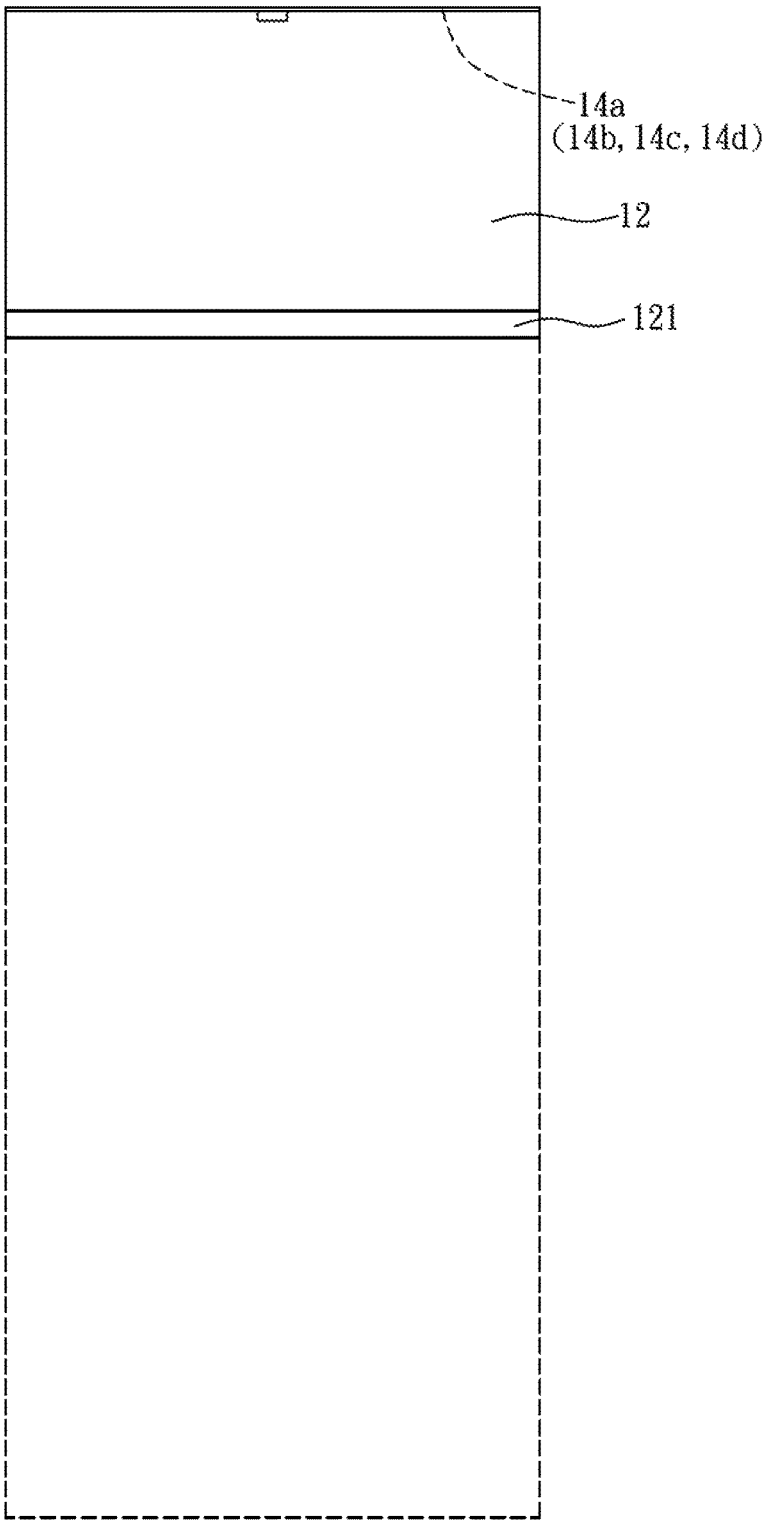
FIG. 8 is a front view of the embodiment in FIG. 1 being moved forward and folded in half the third time according to the present invention.

The preferred length of the lower portion 12 is no less than the length of a half of one of the middle portions 13 with the longest length. As shown in FIG. 1 to FIG. 3, the preferred length of the lower portion 12 is no less than the length of the doubled-over middle portion 13*a* (the length of the middle portion 13*a* is larger than the middle portion 13*b*). Refer to FIG. 8 and FIG. 9, the magnetic curtain 10 is retracted completely. View from a front side (the indoor space A), the lower portion 12 is located at the front side and all doubled-over middle portions (13*a*, 13*b*) and/or the doubled-over upper portion 11 are shaded by the lower portion 12.

The plurality of magnetic parts 14 is arranged at an interface between the two adjacent portions selected from the upper portion 11, the middle portions 13 (13*a*, 13*b*) and the lower portion 12 respectively. Refer to FIG. 2, this embodiment includes a magnetic part 14*a* disposed on an interface between the lower portion 12 and the middle portion 13*a*, a magnetic part 14*b* arranged at an interface between the middle portion 13*a* and the middle portion 13*b*, and a magnetic part 14*c* set on an interface between the middle portion 13*b* and the upper portion 11. Moreover, a magnetic part 14*d* is further disposed on the top end 111 of the upper portion 11. Thus the upper portion 11 is further folded in half after the respective middle portion 13 (13*a*, 13*b*) being doubled-over and the lowest magnetic part 14*a* is attracted to the magnetic part 14*d* while the magnetic curtain 10 being folded and retracted upward, as shown in FIG. 8 and FIG. 9. Therefore the magnetic curtain 10 is positioned at a higher position.

Refer to FIG. 3, each of the magnetic parts 14 (14*a*-14*d*) includes a strip 141 horizontally connected to the magnetic curtain 10, and at least one magnet 142 connected to the strip 141. As shown in FIG. 3, the strip 141 is disposed with two mounting holes each of which is arranged with a magnet 142. Then the strip 141 is passed through and fixed in a groove 15 that is located at the interface between two adjacent portions of the magnetic curtain 10.

Figure 5:
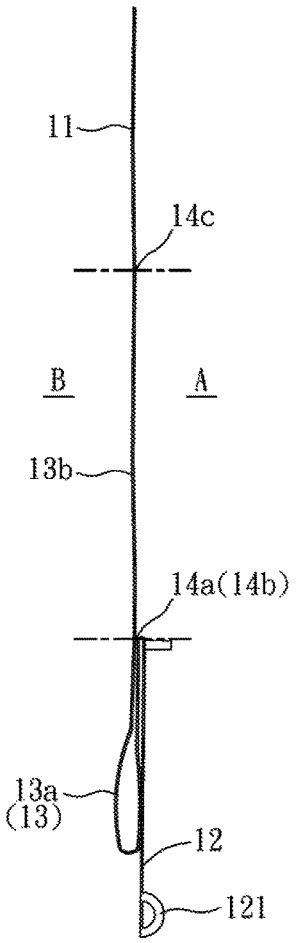
FIG. 5 is a side view of the embodiment in FIG. 1 being moved forward and folded in half the first time according to the present invention.
Figure 4:
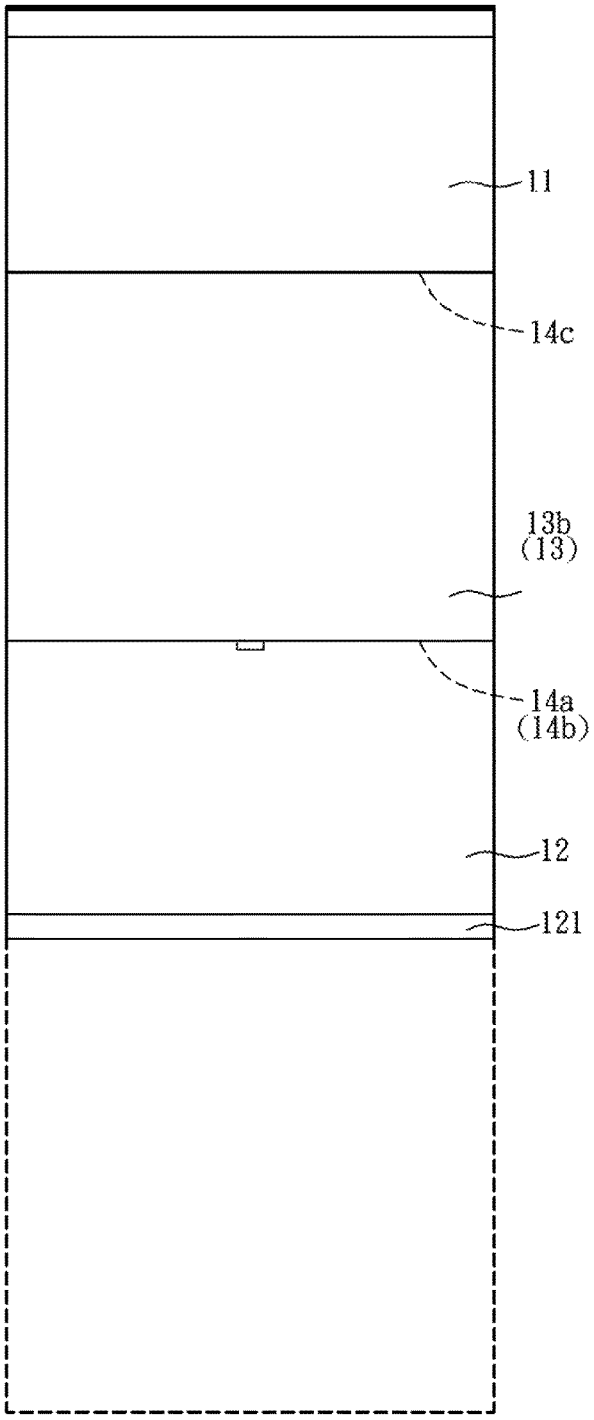
FIG. 4 is a front view of the embodiment in FIG. 1 being moved forward and folded in half the first time according to the present invention.
Figure 6:
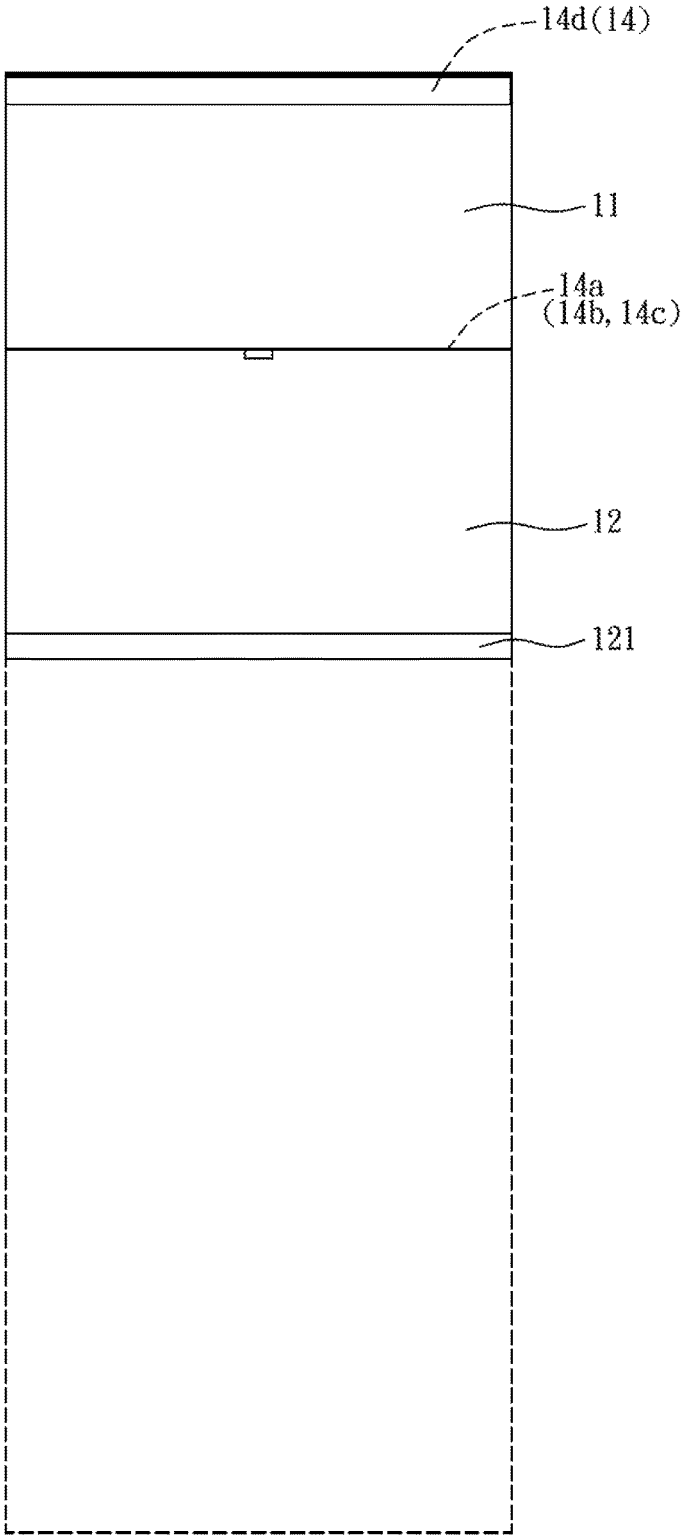
FIG. 6 is a front view of the embodiment in FIG. 1 being moved forward and folded in half the second time according to the present invention.

Refer to FIG. 4 and FIG. 5, while the magnetic curtain 10 is folded and retracted, the magnetic part 14*a* at the lowest position is moved upward and the middle portion 13*a* is folded to form a doubled-over middle portion 13*a*. Then the magnetic part 14*a* and the magnetic part 14*b* are attracted to each other. Thus an extended curved part is formed on the bottom of the middle portion 13*a*. Next the magnetic part 14*b* together with the magnetic part 14*a* is moved upward and the middle portion 13*b* is folded in half. Thus the magnetic parts 14*a*, 14*b* are attracted to the next magnetic part 14*c*, as shown in FIG. 6 and FIG. 7. The middle portion 13*b* is also folded into a doubled-over middle portion 13*b* and an extended curved part is also formed on the bottom of the middle portion 13*b* as shown in FIG. 7. Later the magnetic part 14*c*, the magnetic part 14*b* and the magnetic part 14*a* are moved upward and the upper portion 11 is folded in half. The magnetic parts 14*a*, 14*b* and 14*c* are attracted to the magnetic part 14*d* as shown in FIG. 8 and FIG. 9. The upper portion 11 is also folded into a doubled-over upper portion 11 and an extended curved part is further formed on the bottom of the doubled-over upper portion 11, as shown in FIG. 9. By repeating the above operation time after time, the respective middle portion 13*a*, 13*b* and/or the upper portion 11 is folded into a doubled-over middle portion 13*a*, 13*b* and/or a doubled-over upper portion 11. At the same time, an extended curved part is formed on the bottom of the respective doubled-over portion. Thereby the magnetic curtain 10 is retracted and positioned at the required height, as shown in FIG. 8. The space beyond the folded magnetic curtain 10 can be seen though. When the user intends to extend the magnetic curtain 10 downward, reverse the above procedures. Thus the magnetic curtain 10 turns back to the extended state and used as a shade.

When the two adjacent middle portions 13*a*, 13*b* are folded in half in turn, the lower middle portion 13*a* firstly forms a doubled-over middle portion (13*a*) and then the upper middle portion 13*b* forms a doubled-over middle portion (13*b*) while the doubled-over middle portion (13*b*) formed by the upper middle portion 13*b* is hidden on the rear side of the doubled-over middle portion (13*a*) formed by the lower middle portion 13*a*, as shown in FIG. 7. Refer to FIG. 9, the upper portion 11 is also folded and hidden in the similar way.

In the embodiment shown from FIG. 1 to FIG. 9, this embodiment features on that the length of respective middle portion 13 (13*a*, 13*b*) is gradually decreased from bottom to top. The difference in length between the two adjacent middle portions is, but not limited to 8 cm-14 cm. The length of the folded middle portion 13*b* located at a rear end is smaller than the length of the doubled-over middle portion 13*a* at a front end. Thus there is a certain distance between the curved part on the bottom of the folded middle portion 13*b* and the curved part on the bottom of the folded middle portion 13*a*, as shown in FIG. 7 (or FIG. 9). After the curtain being folded, the curved parts are not overlapped. The problems of prior arts such as U.S. Pat. No. 7,150,304, DE 20 2011 004 612U1, AU2011101135A4, etc. that the appearance of the curtain is affected by the overlapped curved parts can be solved. The overlapped curved parts are seriously protruding and extended from the surface of the curtain. It should be noted that the components shown in FIG. 5, FIG. 7 and FIG. 9 are not drawn to scale.

In addition, the length of the upper portion 11, the lower portion 12, and the plurality of middle portions 13 of the magnetic curtain 10 are set according to the total length of the magnetic curtain 10. For example, the length of respective portion is as the following when the length of a curtain is 160 cm:

From top to bottom, the magnetic curtain 10 includes the upper portion 11 having the length of 30 cm, the middle portion 13*b* having the length of 42 cm, the middle portion 13*a* having the length of 54 cm and the lower portion 12 having the length of 34 cm in turn. The length of the respective portion already includes the tolerance.

Figure 10:
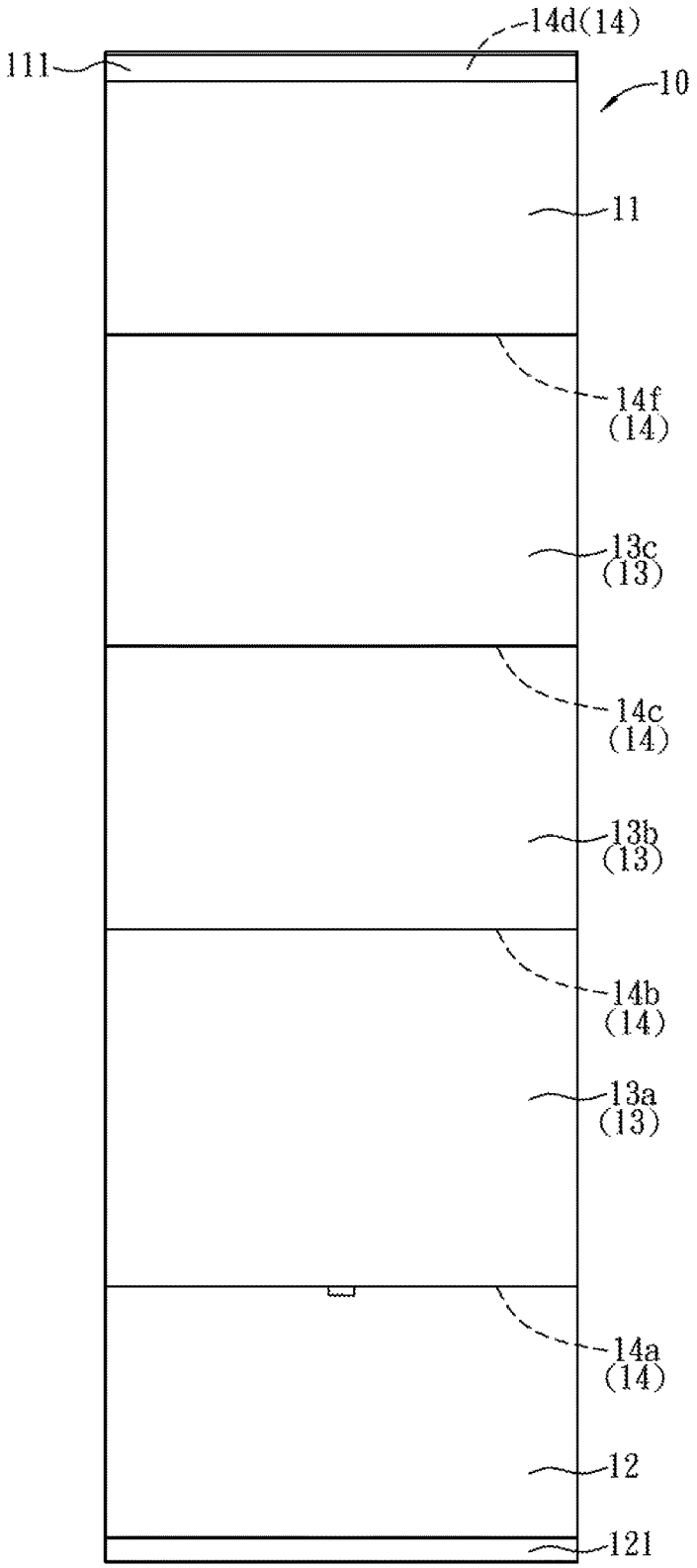
FIG. 10 is a front view of another embodiment having three middle portions with increased length, decreased length and increased length respectively from bottom to top of a magnetic curtain according to the present invention.
Figure 11:
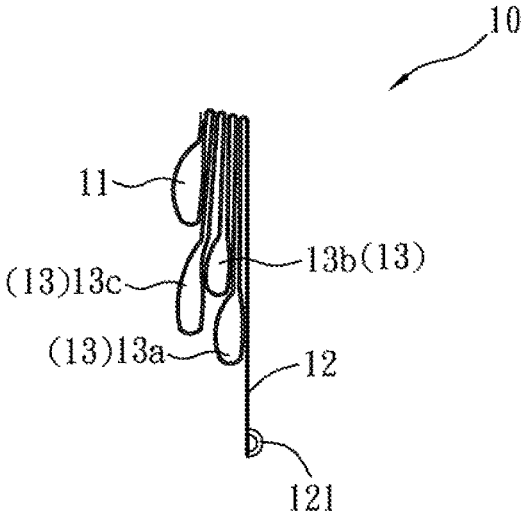
FIG. 11 is a side view of the embodiment in FIG. 10 being moved forward and folded according to the present invention.

Refer to FIG. 10 and FIG. 11, another embodiment is revealed. A plurality of middle portions 13 of this embodiment includes a lower middle portion 13*a*, an intermediate middle portion 13*b* and an upper middle portion 13*c*. The difference between this embodiment and the above embodiment is in that this embodiment includes one more portion—the upper middle portion 13*c* and the length of the respective portion is different. The length of the respective middle portion 13 (13*a*, 13*b*, 13*c*) is decreased and increased by turns from bottom to top. In this embodiment, the length of the lower middle portion 13*a* is larger than the length of the intermediate middle portion 13*b* while the length of the intermediate middle portion 13*b* is smaller than the length of the upper middle portion 13*c*. The length of the upper middle portion 13*c* is longer than the length of the upper portion 11. The length of the respective portion is increased and decreased alternatively. There is a length difference between the two adjacent middle portions (13*a*, 13*b* or 13*b*, 13*c*). The length difference is ranging from 8 cm to 14 cm and able to be the same or not. For example, the length of the lower middle portion 13*a* is 10 cm longer than the length of the intermediate middle portion 13*b* while the length of the intermediate middle portion 13*b* is 10 cm shorter than the length of the upper middle portion 13*c*. Thus the middle portions 13*a*, 13*b*, 13*c* with different length respectively are arranged in the following manner-increased length, decreased length and increased length alternatively and having the same difference in length between the two adjacent portions of the middle portions 13*a*, 13*b*, 13*c*. When the length of the lower middle portion 13*a* is 12 cm longer than the length of the intermediate middle portion 13*b* and the length of the intermediate middle portion 13*b* is 8 cm shorter than the length of the upper middle portion 13*c*, the middle portions 13*a*, 13*b*, 13*c* with different length respectively are arranged in an alternative manner-increased length, decreased length and increased length alternatively while the difference in length between the two adjacent portions of the middle portions 13*a*, 13*b*, 13*c* is different.

In the embodiment shown in FIG. 10 and FIG. 11, the present invention features on that the length of the respective middle portion 13 (13*a*, 13*b*, 13*c*) is in a gradually decreasing manner, a gradually increasing manner or in an alternative manner from bottom to top. Moreover, the difference in length between the two adjacent middle portions can be the same or different. The difference in length is ranging from 8 cm to 14 cm, but not limited. After being retracted upward, there is a certain distance between the curved parts on the bottom of the two adjacent folded middle portions 13*a*, 13*b* or 13*b*, 13*c*, as shown in FIG. 11. The curved parts on the bottom of the two adjacent folded middle portions 13*a*, 13*b* or 13*b*, 13*c* are not overlapped after the magnetic curtain 10 being retracted.

Figure 12:
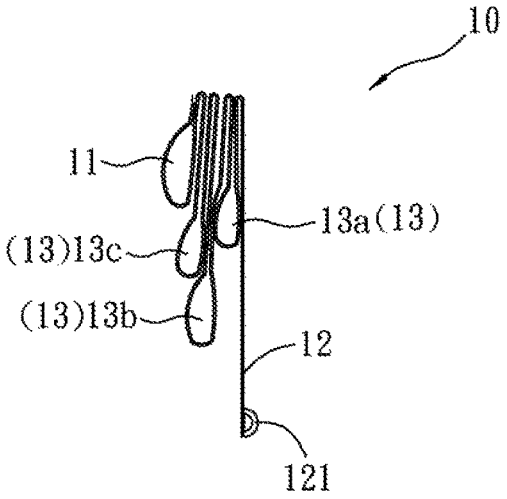
FIG. 12 is a side view of a further embodiment having three middle portions with decreased length, increased length and decreased length respectively from bottom to top of a magnetic curtain being folded according to the present invention.

Refer to FIG. 12, a further embodiment is revealed. The length of the respective middle portion 13*a*, 13*b*, 13*c* shown in FIG. 10 is changed to form this embodiment. In FIG. 12, the length of the lower middle portion 13*a* is smaller than the length of the intermediate middle portion 13*b* while the length of the intermediate middle portion 13*b* is larger than the length of the upper middle portion 13*c* and the length of the upper middle portion 13*c* is longer than the length of the upper portion 11. The middle portions 13*a*, 13*b*, 13*c* with different length are arranged in an alternative manner-decreased length, increased length and decreased length. Compared with the first embodiment shown in FIG. 1 to FIG. 9, this embodiment includes one more middle portion 13*c*. The length of the respective portion 13*a*, 13*b*, 13*c* of this embodiment is different from the length of the respective portion 13*a*, 13*b*, 13*c* of the embodiment shown in FIG. 10 and FIG. 11. There is also a difference in length between two adjacent portions 13*a*, 13*b* or 13*b*, 13*c*. The difference in length can be the same or different and ranging from 8 cm to 14 cm.

In the embodiment shown in FIG. 12, the optimal length of the lower portion 12 is no less than a half of the maximum length of one of the middle portions 13. In FIG. 12, the middle portion 13 with the maximum length is 13*b*. That means the length of the lower portion 12 is no less than the folded middle portion 13*b* with the maximum length among the three middle portions 13*a*, 13*b*, 13*c*. After the magnetic curtain 10 being folded and retracted completely, the lower portion 12 is located on a front end and the folded middle portions 13*a*, 13*b*, 13*c* and/or the folded upper portion 11 are all shaded by the lower portion 12. The embodiment in FIG. 12 has the same technical features and functions as the embodiment shown in FIG. 10 and FIG. 11.

Figure 13:
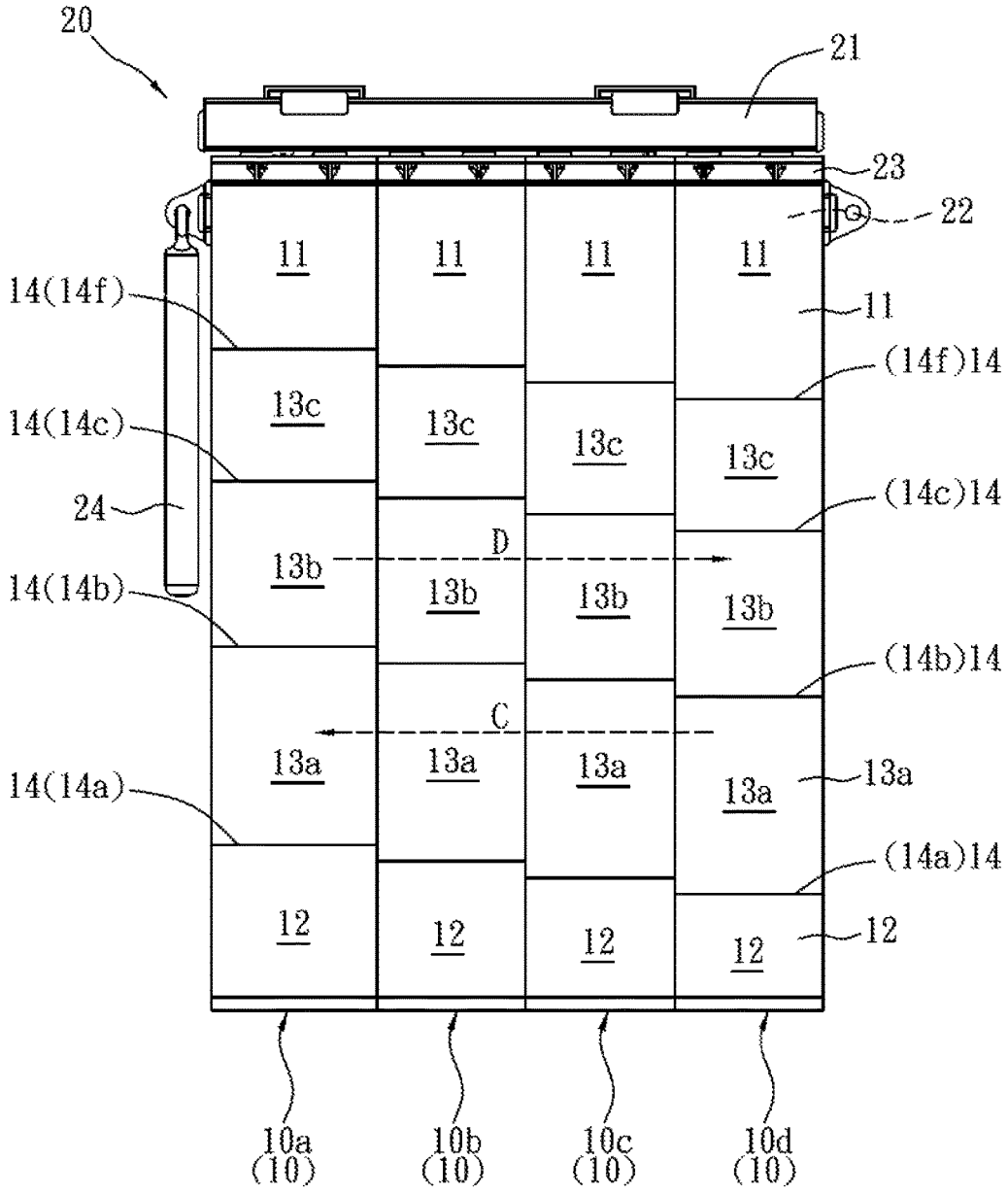
FIG. 13 is a front view of an embodiment of a sliding panel formed from magnetic curtains according to the present invention.
Figure 14:
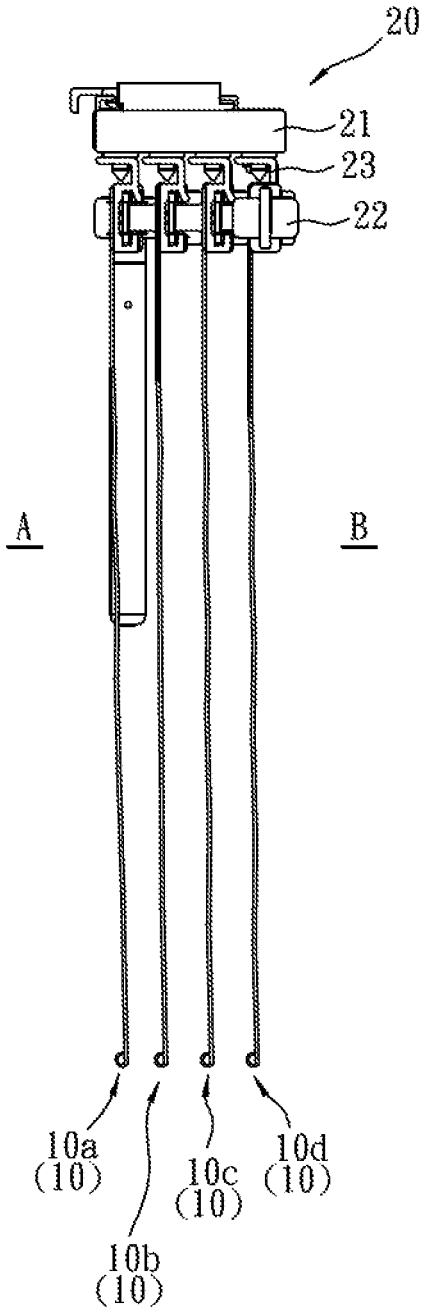
FIG. 14 is a side view of an embodiment of a sliding panel formed from magnetic curtains according to the present invention.

Refer to FIG. 13 and FIG. 14, a sliding panel 20 formed by magnetic curtains 10 of the present invention includes a rail set 21, a plurality of carrier tracks 22, a plurality of connecting pieces 23 and a plurality of magnetic curtains 10. The rail set 21 is formed by a plurality of parallel channels (not shown in figure) each of which has an opening facing downward. The connecting piece 23 is disposed on top of the carrier track 22 and is connected to a runner (not shown in figure). By the respective runner mounted and slid in the respective channel, the respective carrier track 22 is slid in parallel under the rail set 21. Each magnetic curtain 10 is connected to and hung from the carrier track 22 correspondingly. This sliding panel is operated as the conventional sliding panel. Being driven by an operation rod 24, the respective magnetic curtain 10 and the corresponding carrier track 22 are slid under the rail set 21 and gradually extended (as an arrow C in FIG. 13 indicates). Thus the sliding panel 20 forms the shade between the indoor space A and the outdoor space B. Or the respective magnetic curtain 10 is gradually retracted (as an arrow D in FIG. 13 indicates) to be overlapped at one side (not shown in figure), and users in the indoor space A can see the outdoor space B.

As shown in FIG. 13 and FIG. 14, a plurality of magnetic curtains 10 (10*a*, 10*b*, 10*c*, 10*d*) is used as panels of the sliding panel 20 and is used in combination with other components of the sliding panel 20. As shown in FIG. 13, the sliding panel 20 includes four magnetic curtains 10 but the number of the magnetic curtains 10 is not limited. The respective magnetic curtain 10*a*, 10*b*, 10*c*, 10*d* includes an upper portion 11, a lower portion 12, a plurality of middle portions 13 (13*a*, 13*b*, 13*c*) between the upper portion 11 and the lower portion 12, and a plurality of magnetic parts 14 (14*a*, 14*b*, 14*c*, 14*f*) arranged at an interface between two adjacent portions 11, 13*a*, 13*b*, 13*c* and 12.

Take the sliding panel 20 shown in FIG. 13 as an example. The length of the respective magnetic curtain 10 of the sliding panel 20 is longer than the magnetic curtain 10 shown in FIG. 1 and FIG. 12. The middle portions 13 (13*a*, 13*b*, 13*c*) of the sliding panel 20 include one more portion 13*c* for increasing the length of the respective magnetic curtain 10. The respective magnetic curtain 10 (10*a*, 10*b*, 10*c*, 10*d*) in this embodiment still keeps technical features of the magnetic curtain 10 of the embodiments shown in FIG. 1 to FIG. 12.

Refer to FIG. 13, the magnetic parts 13 (14*a*, 14*b*, 14*c*, 14*f* on two magnetic curtains 10 (such as 10*a* & 10*b*, 10*b* & 10*c*, or 10*c* & 10*d*) or three adjacent magnetic curtains 10 (such as 10*a*, 10*b*, & 10*c*, or 10*b*, 10*c*, & 10*d*) are arranged at different heights. There is a height difference between the respective magnetic part 14 (14*a*, 14*b*, 14*c*, 14*f* on the magnetic curtain 10*a* and the respective magnetic part 14 (14*a*, 14*b*, 14*c*, 14*f* on the magnetic curtain 10*b* or 10*c*. Similarly, there is also height difference between the respective magnetic part 14 (14*a*, 14*b*, 14*c*, 14*f* on the magnetic curtain 10*b* and the respective magnetic part 14 (14*a*, 14*b*, 14*c*, 14*f* on the magnetic curtain 10*c* or 10*d*. There is height difference between the positions of the respective magnetic part 14 (14*a*, 14*b*, 14*c*, 14*f*) on the magnetic curtain 10*c* and the positions of the respective magnetic part 14 (14*a*, 14*b*, 14*c*, 14*f* on the magnetic curtain 10*d*. When each magnetic curtain 10 (10*a*, 10*b*, 10*c*, 10*d*) is slid and extended (as the arrow C indicates) horizontally under the rail set 21, or is retracted (as the arrow D indicates) to be overlapped at one side (such as overlapped at the position of the magnetic curtain 10*d*), the magnetic parts 14 on the two adjacent magnetic curtains 10 (such as 10*a* & 10*b*, 10*b* & 10*c*, or 10*c* & 10*d*) or the adjacent three magnetic curtains 10 (such as 10*a*, 10*b* and 10*c* or 10*b*, 10*c* and 10*d*) will not be attracted to one another due to the height difference. Thus the next operation such as extension or retraction of the magnetic curtains 10 will not be affected.

Moreover, in the sliding panel 20 shown in FIG. 13, the length of the upper portion 11, the lower portion 12 and each middle portion 13 (13*a*, 13*b*, 13*c*) of the respective magnetic curtain 10 (10*a*, 10*b*, 10*c*, 10*d*) is different so as to have a difference between the two adjacent portions. Although the total length of the respective magnetic curtain 10 (10*a*, 10*b*, 10*c*, 10*d*) is the same, the upper portions 11, the lower portions 12 and the plurality of middle portions 13 (13*a*, 13*b*, 13*c*) are arranged at different heights. Each middle portion 13 (13*a*, 13*b*, 13*c*) of the respective magnetic curtain 10*a*, 10*b*, 10*c*, and 10*d* can have the same length and size. That means the length and the size of each middle portion 13*a*, 13*b*, 13*c* of the magnetic curtain 10*a* are the same as those of each middle portion 13*a*, 13*b*, 13*c* of the magnetic curtain 10*b*/10*c*/10*d*. Yet the upper portion 11 and the lower portion 12 of the respective magnetic curtain 10*a*, 10*b*, 10*c*, and 10*d* have different length and size. That means the height of the upper portion 11 and the height of the lower portion 12 of the magnetic curtain 10*a* are not at the same height as the height of each middle portion 13*a*, 13*b*, 13*c* of the respective magnetic curtain 10*b*/10*c*/10*d*.

Figure 15:
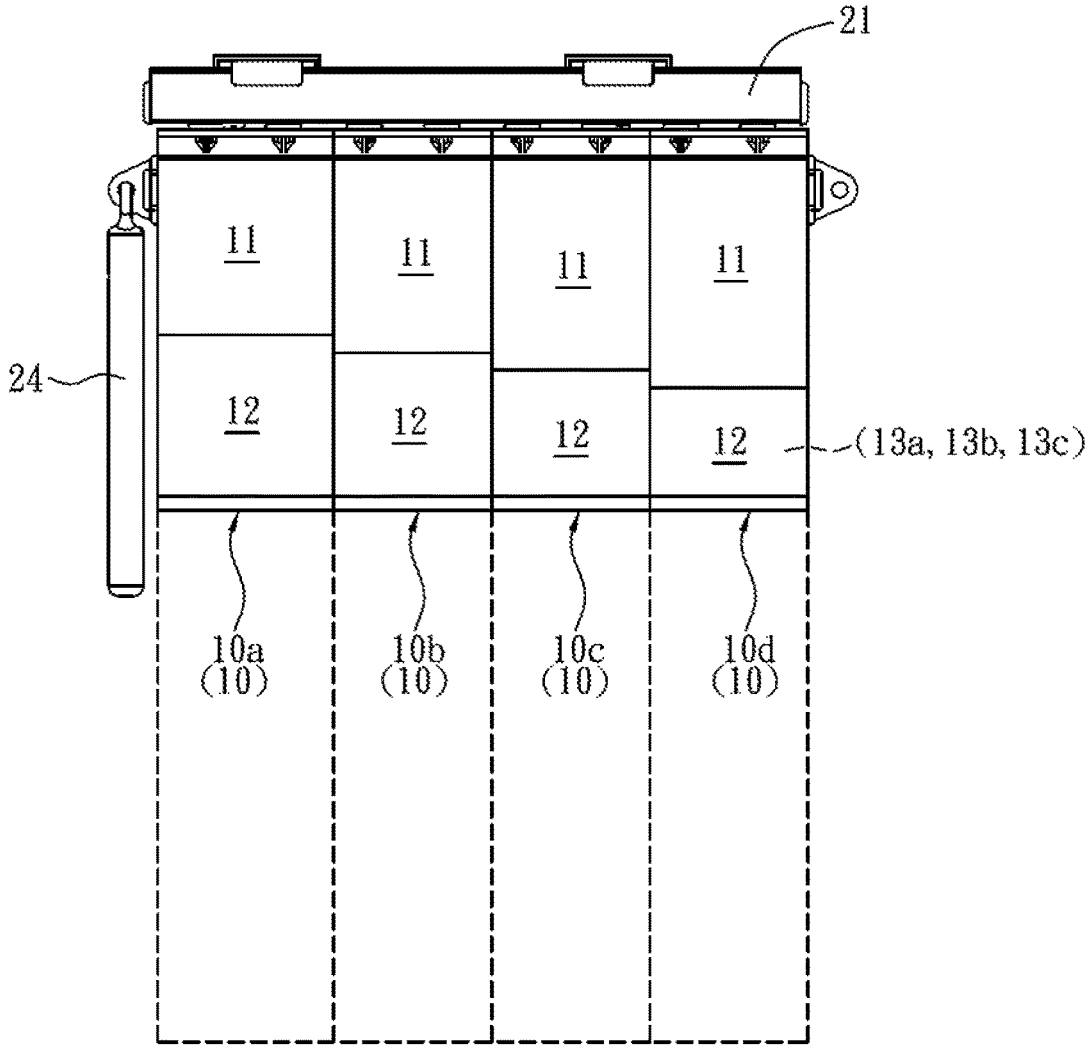
FIG. 15 is a front view showing the embodiment in FIG. 13 in which the respective folded magnetic curtain is at the same height according to the present invention.

Refer to FIG. 13, the sum of the length of the upper portion 11 and the length of the lower portion 12 of the respective magnetic curtain 10*a*, 10*b*, 10*c*, 10*d* is the same. That means the total length of the upper portion 11 and the lower portion 12 of the magnetic curtain 10*a* is the same as those of other magnetic curtain 10*b*, 10*c*, and 10*d*. Thus the difference between the length of the lower portion 12 of the magnetic curtain 10*a* and the length of the lower portion 12 of other magnetic curtain 10*b*/10*c*/10*d* is the same as the difference between the length of the upper portion 11 of the magnetic curtain 10*a* and the length of the upper portion 11 of other magnetic curtain 10*b*/10*c*/10*d*. After the respective middle portion 13 (13*a*, 13*b*, 13*c*) being folded in half in turn and the respective magnetic curtain 10*a*, 10*b*, 10*c*, 10*d* being retracted, the magnetic part 14*a* at the lowest position is finally attracted to the magnetic part 14*f* on the bottom end of the upper portion 11 so that the respective magnetic curtain 10*a*, 10*b*, 10*c*, 10*d* is retracted and positioned at the same height, as shown in FIG. 15. This is due to that the sum of the length of the upper portion 11 and the length of the lower portion 12 of the respective magnetic curtain 10*a*, 10*b*, 10*c*, and 10*d* is the same.

Figure 16:
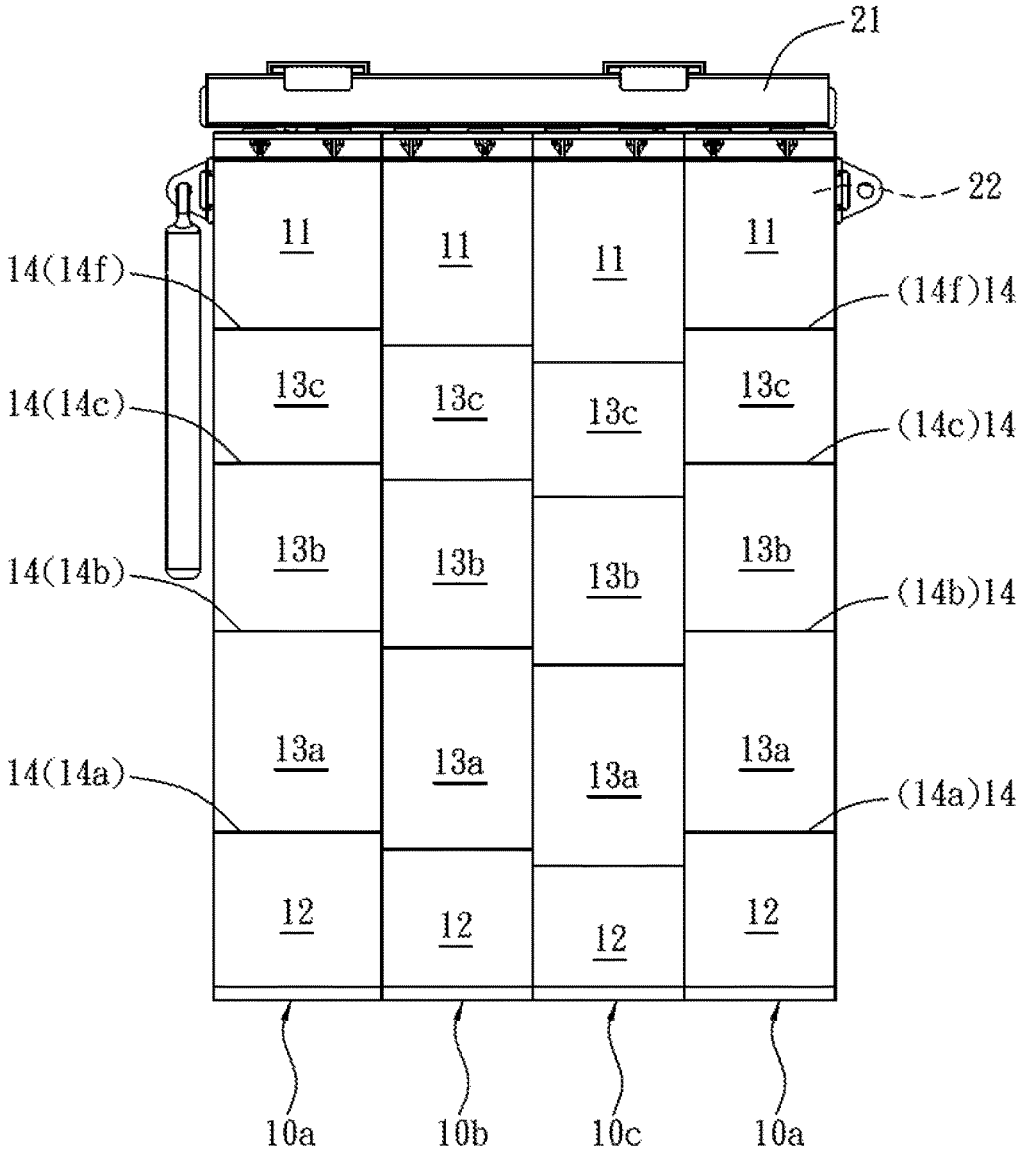
FIG. 16 is a front view of another embodiment of a sliding panel formed from magnetic curtains according to the present invention.
Figure 17:
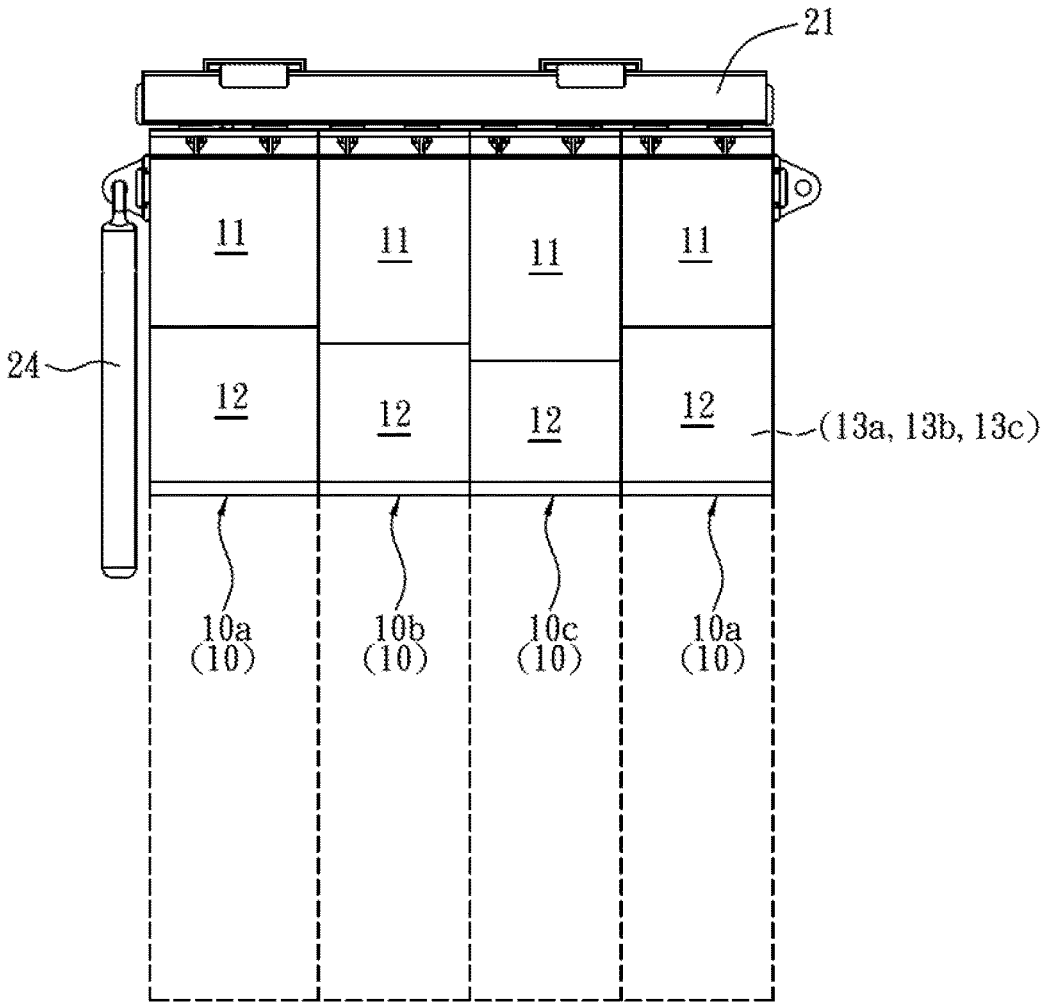
FIG. 17 is a front view showing the embodiment in FIG. 16 in which the respective folded magnetic curtain is at the same height according to the present invention.

Refer to FIG. 16 and FIG. 17, another embodiment of a sliding panel 20 including four magnetic curtains 10 is revealed. The difference of this embodiment and the above embodiment shown in FIG. 13, FIG. 14 and FIG. 15 is in that the above embodiment includes four different magnetic curtain 10*a*, 10*b*, 10*c*, 10*d* disposed from left to right in turn while this embodiment includes three different magnetic curtain 10*a*, 10*b*, 10*c* and one magnetic curtain 10*a* the same as the leftmost magnetic curtain 10*a*. The embodiment shown in FIG. 16 and FIG. 17 includes four magnetic curtain 10*a*, 10*b*, 10*c*, 10*a* arranged in turn from left to right. The magnetic curtains 10*a*, 10*b*, 10*c*, 10*d*/10*a*, 10*b*, 10*c* are different in the positions of the upper portion 11, the middle portions 13 and the lower portion 12. This embodiment of the sliding panel 20 has the same technical features and functions as the above embodiment of the sliding panel 20 shown in FIG. 13 to FIG. 15.

Furthermore, the length of each portion 11, 12, 13 of the respective magnetic curtain 10 (10*a*, 10*b*, 10*c*, 10*d*) is set according to the length of the sliding panel 20. The following is an example showing the length of each portion of the respective magnetic curtain 10 (10*a*, 10*b*, 10*c*, 10*d*) when the total length of a sliding panel is 210 cm.

Refer to FIG. 13, FIG. 14 and FIG. 15, when the length of the sliding panel 20 having four magnetic curtains 10 (10*a*, 10*b*, 10*c*, 10*d*) is 210 cm, the length of each portion of the respective magnetic curtain 10*a*, 10*b*, 10*c*, 10*d* is as the following: the first magnetic curtain 10*a* includes an upper portion 11 with a length of 10 cm, a middle portion 13*c* with a length of 40 cm, a middle portion 13*b* with a length of 50 cm, a middle portion 13*c* with a length of 60 cm, and a lower portion 12 with a length of 50 cm in turn from top to bottom. The second magnetic curtain 10*b* includes an upper portion 11 with a length of 15 m, a middle portion 13*c* with a length of 40 cm, a middle portion 13*b* with a length of 50 cm, a middle portion 13*c* with a length of 60 cm, and a lower portion 12 with a length of 45 cm in turn from top to bottom. The third magnetic curtain 10*c* includes an upper portion 11 with a length of 20 cm, a middle portion 13*c* with a length of 40 cm, a middle portion 13*b* with a length of 50 cm, a middle portion 13*c* with a length of 60 cm, and a lower portion 12 with a length of 40 cm in turn from top to bottom. The fourth magnetic curtain 10*d* includes an upper portion 11 with a length of 25 cm, a middle portion 13*c* with a length of 40 cm, a middle portion 13*b* with a length of 50 cm, a middle portion 13*c* with a length of 60 cm, and a lower portion 12 with a length of 35 cm in turn from top to bottom. The sum of the length of the upper portion 11 and the length of the lower portion 12 of the respective magnetic curtain 10 (10*a*, 10*b*, 10*c*, 10*d*) is 60 cm. Each length already includes the tolerance.

Refer to FIG. 16 and FIG. 17, when the length of the sliding panel 20 having four magnetic curtains 10 (10*a*, 10*b*, 10*c*, 10*a*) is 210 cm, the length of each portion of the respective magnetic curtain 10*a*, 10*b*, 10*c*, 10*a* is as the following: the first magnetic curtain 10*a* includes an upper portion 11 with a length of 10 cm, a middle portion 13*c* with a length of 40 cm, a middle portion 13*b* with a length of 50 cm, a middle portion 13*c* with a length of 60 cm, and a lower portion 12 with a length of 50 cm in turn from top to bottom. The second magnetic curtain 10*b* includes an upper portion 11 with a length of 15 m, a middle portion 13*c* with a length of 40 cm, a middle portion 13*b* with a length of 50 cm, a middle portion 13*c* with a length of 60 cm, and a lower portion 12 with a length of 45 cm in turn from top to bottom. The third magnetic curtain 10*c* includes an upper portion 11 with a length of 20 cm, a middle portion 13*c* with a length of 40 cm, a middle portion 13*b* with a length of 50 cm, a middle portion 13*c* with a length of 60 cm, and a lower portion 12 with a length of 40 cm in turn from top to bottom. The fourth magnetic curtain 10*a* includes an upper portion 11 with a length of 10 cm, a middle portion 13*c* with a length of 40 cm, a middle portion 13*b* with a length of 50 cm, a middle portion 13*c* with a length of 60 cm, and a lower portion 12 with a length of 50 cm in turn from top to bottom. The fourth magnetic curtain 10*a* is the same as the first magnetic curtain 10*a*. The sum of the length of the upper portion 11 and the length of the lower portion 12 is 60 cm.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A sliding panel formed from a plurality of magnetic curtains comprising:

a rail set having a plurality of parallel channels;

a plurality of carrier tracks each is disposed with a connector on a top end thereof and a runner is arranged over the connector; each of the carrier tracks is slid under the rail set by the runner slid in the channel of the rail set;

a plurality of magnetic curtains each of which is connected to and hung from the carrier track correspondingly; thus each of the magnetic curtain and the corresponding carrier track are slid horizontally under the rail set to be gradually extended and forming a shade for a window; or each of the magnetic curtain and the corresponding carrier track are slid horizontally under the rail set to be gradually retracted and users are allowed to see through the window;

wherein each of the magnetic curtain includes an upper portion, a lower portion, a plurality of middle portions arranged between the upper portion and the lower portion, and a plurality of magnetic parts disposed on an interface between two adjacent portions of the upper portion, the middle portions and the lower portion;

wherein the magnetic parts on the two adjacent magnetic curtains are not at the same height and there is a height difference between the magnetic parts on one of the two adjacent magnetic curtains and the magnetic parts on the other magnetic curtain; the magnetic parts on the two adjacent magnetic curtains will not be attracted to each other due to the height difference while the magnetic curtains are slid horizontally under the rail set to be extended gradually or retracted gradually.

2. The device as claimed in claim 1, wherein the magnetic parts on the three adjacent magnetic curtains are not at the same height and there is a height difference between the magnetic parts on one of the three adjacent magnetic curtains and the magnetic parts on the rest two adjacent magnetic curtains; thus the magnetic parts on the two adjacent magnetic curtains will not be attracted to each other due to the height difference while the magnetic curtains are slid horizontally under the rail set to be extended gradually or retracted gradually.

3. The device as claimed in claim 1, wherein the sum of the length of the upper portion and the length of the lower portion of each of the magnetic curtains is the same; a difference between the length of the lower portions of one of the two adjacent magnetic curtains and the length of the lower portion of the other magnetic curtain will be compensated by the difference between the length of the upper portions of one of the two adjacent magnetic curtains and the length of the upper portion of the other magnetic curtain; thus each of the magnetic curtains is retracted and positioned at the same height after each of the middle portion being folded in half in turn and the lowest magnetic part being attached to the magnetic part between the upper portion and the uppermost middle portion.

4. The device as claimed in claim 1, wherein the sliding panel includes four magnetic curtains and a length of the sliding panel is 210 cm;

wherein a first magnetic curtain includes the upper portion with a length of 10 cm, the middle portion with a length of 40 cm, the middle portion with a length of 50 cm, the middle portion with a length of 60 cm, and the lower portion with a length of 50 cm in turn from top to bottom;

wherein a second magnetic curtain includes the upper portion with a length of 15 cm, the middle portion with a length of 40 cm, the middle portion with a length of 50 cm, the middle portion with a length of 60 cm, and the lower portion with a length of 45 cm in turn from top to bottom;

wherein a third magnetic curtain includes the upper portion with a length of 20 cm, the middle portion with a length of 40 cm, the middle portion with a length of 50 cm, the middle portion with a length of 60 cm, and the lower portion with a length of 40 cm in turn from top to bottom;

wherein a fourth magnetic curtain includes the upper portion with a length of 25 cm, the middle portion with a length of 40 cm, the middle portion with a length of 50 cm, the middle portion with a length of 60 cm, and the lower portion with a length of 35 cm in turn from top to bottom;

wherein the sum of the length of the upper portion and the length of the lower portion of each of the four magnetic curtains is 60 cm; the length of the upper portion, the length of each of the middle portions and the length of the lower portion all include a tolerance respectively.

5. The device as claimed in claim 1, wherein the sliding panel includes four magnetic curtains and a length of the sliding panel is 210 cm;

wherein a first magnetic curtain includes the upper portion with a length of 10 cm, the middle portion with a length of 40 cm, the middle portion with a length of 50 cm, the middle portion with a length of 60 cm, and the lower portion with a length of 50 cm in turn from top to bottom;

wherein a second magnetic curtain includes the upper portion with a length of 15 cm, the middle portion with a length of 40 cm, the middle portion with a length of 50 cm, the middle portion with a length of 60 cm, and the lower portion with a length of 45 cm in turn from top to bottom;

wherein a third magnetic curtain includes the upper portion with a length of 20 cm, the middle portion with a length of 40 cm, the middle portion with a length of 50 cm, the middle portion with a length of 60 cm, and the lower portion with a length of 40 cm in turn from top to bottom;

wherein a fourth magnetic curtain includes the upper portion with a length of 10 cm, the middle portion with a length of 40 cm, the middle portion with a length of 50 cm, the middle portion with a length of 60 cm, and the lower portion with a length of 50 cm in turn from top to bottom;

wherein the fourth magnetic curtain is the same as the first magnetic curtain;

wherein the sum of the length of the upper portion and the length of the lower portion of each of the four magnetic curtains is 60 cm; the length of the upper portion, the length of each of the middle portions and the length of the lower portion all include a tolerance respectively.

* * * * *